United States Patent [19]

Chen

[11] Patent Number: 4,973,003

[45] Date of Patent: Nov. 27, 1990

[54] GRINDING APPARATUS

[76] Inventor: Chi-Shiang Chen, No. 15, Chung-Shan Rd., Hsu-Au Chen, Ilan Hsien, Taiwan

[21] Appl. No.: 386,729

[22] Filed: Jul. 31, 1989

[51] Int. Cl.[5] ..... B02C 23/18

[52] U.S. Cl. ..... 241/56; 241/67; 241/257 R; 241/259.1; 241/261.1

[58] Field of Search ..... 241/259.1, 65, 259.2, 241/66, 259.3, 67, 56, 248, 257 R, 258, 261.1, 250

[56] References Cited

U.S. PATENT DOCUMENTS

| | | | |
|---|---|---|---|
| 856,311 | 6/1907 | Sturtevant et al. | 241/257 R |
| 1,262,091 | 4/1918 | Pratt | 241/250 |
| 1,794,972 | 3/1931 | Mayer | 241/257 X |
| 1,851,071 | 3/1932 | Travis | 241/67 X |
| 2,342,252 | 2/1944 | Claybourn et al. | 241/257 R |
| 2,749,814 | 6/1956 | Haug | 241/257 R X |
| 3,398,900 | 8/1968 | Guba et al. | 241/67 |
| 4,469,284 | 9/1984 | Brubaker et al. | 241/261.1 X |

FOREIGN PATENT DOCUMENTS

| | | | |
|---|---|---|---|
| 169140 | 1/1986 | European Pat. Off. | 241/261.1 |
| 830602 | 1/1952 | Fed. Rep. of Germany | 241/261.1 |

*Primary Examiner*—Mark Rosenbaum

*Attorney, Agent, or Firm*—Harness, Dickey & Pierce

[57] ABSTRACT

A grinding apparatus includes a frame, a first grinding assembly mounted on the frame for rotating about a vertical axis and a second grinding assembly supported on the frame and sleeved around the first grinding assembly. The first grinding assembly has a substantially truncated cone-shaped member with an external frusto-conical grinding surface. The truncated cone-shaped member is tapered upward. The second grinding assembly has an internal frusto-conical grinding surface to contact the external frusto-conical grinding surface of the truncated cone-shaped member for grinding. A driving device is provided for rotating the first grinding assembly about the vertical axis with respect to the second grinding assembly.

6 Claims, 3 Drawing Sheets

GRINDING APPARATUS

BACKGROUND OF THE INVENTION

This invention relates to a grinding apparatus, more particularly to a grinding apparatus which has a large grinding surface.

Stone powders are widely used in architecture and civil engineering. These stone powders are generally made from rough stones by means of a grinding apparatus. A conventional grinding apparatus, such as that illustrated in FIG. 1, generally includes a body frame and a driving means (B) for driving a grinding seat (C) to rotate. In this illustrated grinding apparatus, two types of grinding wheels (D), (E) are shown. One type of said grinding wheel (D) has a truncated conical shape and rests on a flat grinding plate C1 mounted in the grinding seat (C). The other type of said grinding wheel (E) also has a truncated conical shape and rests on an arcuate grinding plate C2 which is also mounted in the grinding seat (C). The grinding wheels (D), (E) are respectively and rotatably connected to the shafts D1, E1 which are in turn respectively connected to the pivot arms D2, E2. The raw material to be ground, such as rough stones, is fed into the body frame (A) from two sides (F) of the body frame (A) so as to be ground between the grinding wheels (D), (E). In addition, air is blown into the body frame (A) via air tubes (G) mounted in the lower portion of the body frame (A) so as to enable the ground stone powder to be collected into a collecting hood (H) and a collecting pipe (P). However, the grinding wheels (D), (E) come in contact with only a very narrow, limited area of the flat grinding plate C1, C2, thus adversely affecting the grinding efficiency.

SUMMARY OF THE INVENTION

It is therefore a main object of this invention to provide a grinding apparatus which has two grinding assemblies defining a large grinding area therebetween for grinding.

Accordingly, a grinding apparatus of this invention includes a frame; a first grinding assembly mounted on the frame for rotating about a vertical axis, the first grinding assembly having a substantially truncated cone-shaped member with an external frusto-conical grinding surface, the truncated cone-shaped member tapering upward; a second grinding assembly supported on the frame and sleeved around the first grinding assembly, the second grinding assembly having an internal frusto-conical grinding surface adapted to be in contact with the external frusto-conical grinding surface of the truncated cone-shaped member for grinding; and means for rotating the first grinding assembly about the vertical axis. Therefore, a large frusto-conical grinding area is formed between the external and internal frusto-conical grinding surfaces of the first and second grinding assemblies.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
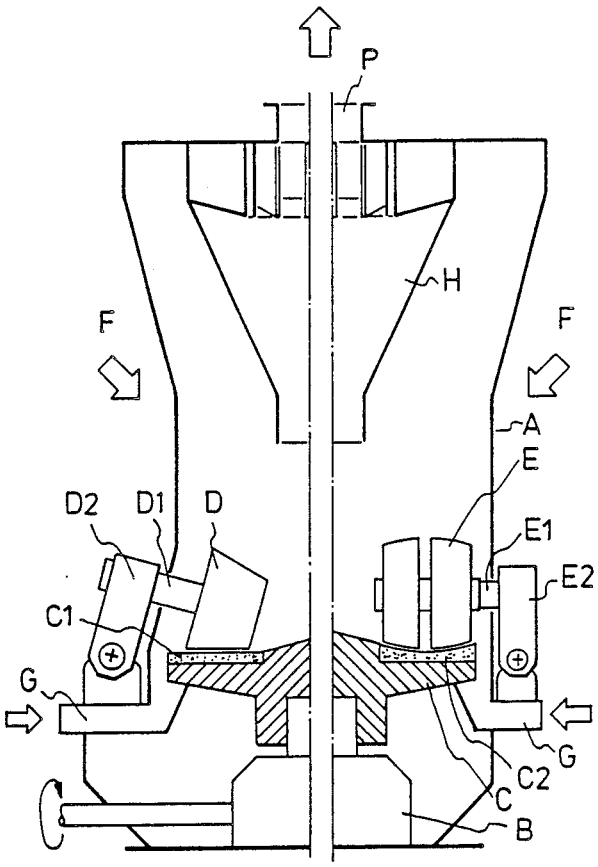
FIG. 1 (PRIOR ART)
FIG. 1 is a sectional schematic view of a conventional grinding apparatus.
Figure 2:
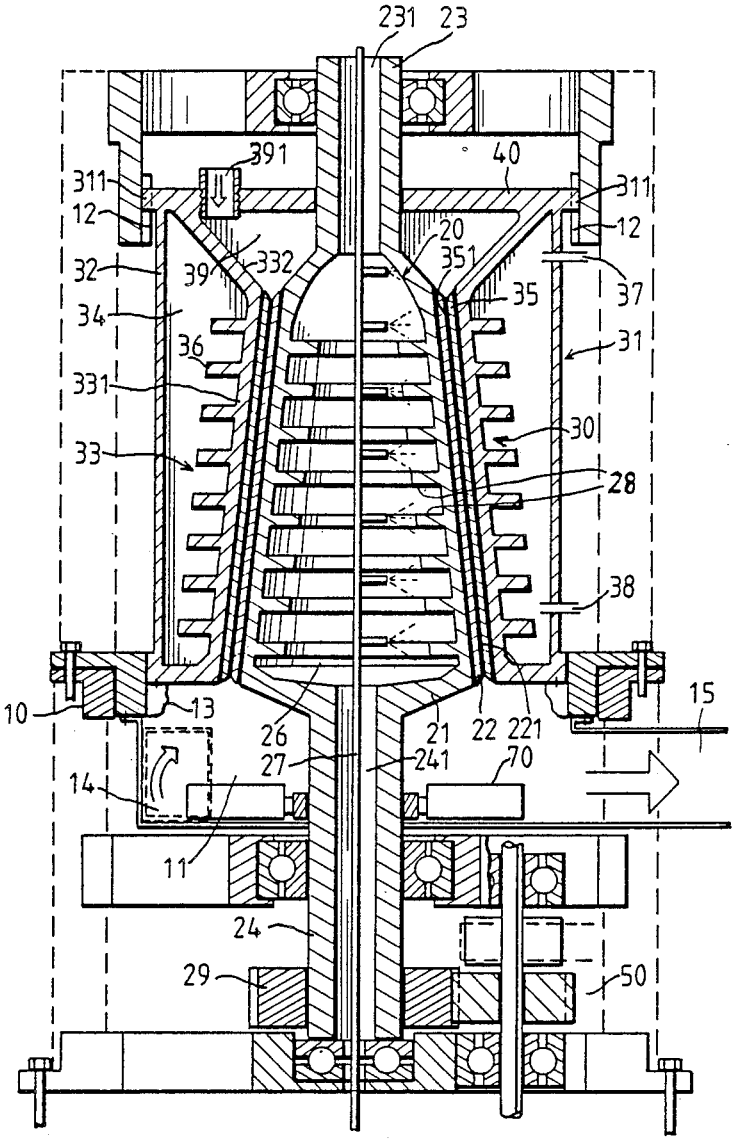
FIG. 2 is a schematic sectional view of a first preferred embodiment of a grinding apparatus of this invention.

Referring to FIG. 2, a schematic sectional view of a preferred embodiment of a grinding apparatus according to this invention is shown. The grinding apparatus includes a supporting frame 10, a first grinding assembly 20 mounted on said frame 10 for rotating about a vertical axis and a second grinding assembly 30 supported in said frame which and sleeves around the first grinding assembly 20. The first grinding assembly 20 includes an upper hollow shaft 23 and a lower hollow shaft 24 axially connected with a truncated cone-shaped member 21. A substantially truncated cone-shaped chamber 26 is formed in the truncated cone-shaped member 21. Two upper and lower channels 231, 241 are formed in the hollow shafts 23, 24 respectively, and are in communication with the truncated cone-shaped chamber 21. A cooling tube 27, extending through the channels 231, 241 and the chamber 26, constantly dispenses cool water during operation of the apparatus for the purpose of cooling the truncated cone-shaped member 21 of the rotating first grinding assembly 20, and is best illustrated in the drawings. A first grinding member 22 is snugly attached to the outer face of the truncated cone-shaped member 21 and has an external frusto-conical grinding surface 221 formed thereon.

The second grinding assembly 30 includes a drum member 31 having a cylindrical outer wall 32 and an inner wall 33 which defines an annular chamber 34 with the outer wall 32. The annular chamber 34 is filled with cool water for cooling the second grinding assembly 30 during the grinding process. Two openings 37, 38 are provided as a water-inlet and a water-outlet. The inner wall 33 surrounds the first grinding member 21 of the first grinding assembly 20 and has an upwardly tapered frusto-conical inner wall portion 331 which snugly sleeves a second grinding member 35. The second grinding member 35 has an internal frusto-conical grinding surface 351 formed thereon. The second grinding assembly 30 is gravitationally disposed on the first grinding assembly 20 with the external and internal frusto-conical grinding surfaces 221, 351 being in contact with each other. The drum member 31 has a pair of diametrically opposed lugs 311 protruding therefrom and the supporting frame 10 has two opposed axial grooves 12 formed in the upper portion of the supporting frame 10. The lugs 311 are axially and slidably received in the axial grooves 12 so that the second grinding assembly 30 can move upward and downward and is prevented from being rotated relative to said supporting frame 10. The truncated cone-shaped member 21 of the first grinding assembly 20 has a plurality of ribs 28 projecting radially and inwardly from an inner face thereof so as to facilitate the cooling effect of the truncated cone-shaped chamber 26. The inner wall 33 of the second grinding assembly 30 also has a plurality of annular protrusions 36 extending from an inner face of the inner wall 33 of the second grinding assembly 30 for enhancing the cooling effect of the annular chamber 34. The inner wall 33 of the drum member 31 further includes an upwardly diverging frusto-conical inner wall portion 332 extending from the upwardly tapered frusto-conical inner wall portion 331 to the outer wall 32. A cover 40 is formed above the upwardly diverging frusto-conical inner wall portion 332 defining a feeding chamber 39 with an upper end of the truncated cone-shaped member 21 of the first grinding assembly 20. The cover 40 is passed through by the upper hollow shaft 23 of the first grinding assembly 20 and has a feeding opening 391 formed thereof. A driving device 50 is mounted on the lower portion of the supporting frame 10 and is operatively associated with a gear wheel 26 provided on the lower shaft 24 of the first grinding assembly 20 so as to rotate the first grinding assembly 20 with respect to the second grinding assembly 30.

In operation, the drum member 31 is slightly lifted upward either manually or mechanically so as to separate the internal frusto-conical grinding surface 351 of the second grinding assembly 30 from the external frusto-conical grinding surface 221 of the first grinding assembly 20 thereby defining a clearance therebetween. In this way, a large grinding area is simultaneously provided between the first and second grinding assembly. The raw materials to be ground, such as rough stones, is then forced into the feeding chamber 39, passing through the feeding opening 391. The driving device 50 is actuated to rotate the first grinding assembly 20 in a manner as described hereinbefore. Since there is a clearance formed between the internal and external grinding surfaces 351, 221, the rough stones to be ground are easily directed into said grinding area formed in said clearance. Once the rough stones to be ground entered said grinding area, the drum member 31 of the second grinding assembly 30 is released to gravitate toward the truncated cone-shaped member 21 of the first grinding assembly 20. Therefore, the drum member 31 constantly exerts a downward pressure, which is caused by the weight of the drum member 31, on the stone pieces to be ground thereby achieving an excellent grinding effect. The ground stone powders then fall into a powder-receiving chamber 11 located under the first and second grinding assemblies 20, 30. A fan 70 and an air-blowing port 14 are provided in the powder-receiving chamber 11 for discharging the ground stone powders through a powder-outlet 15.

Figure 3:
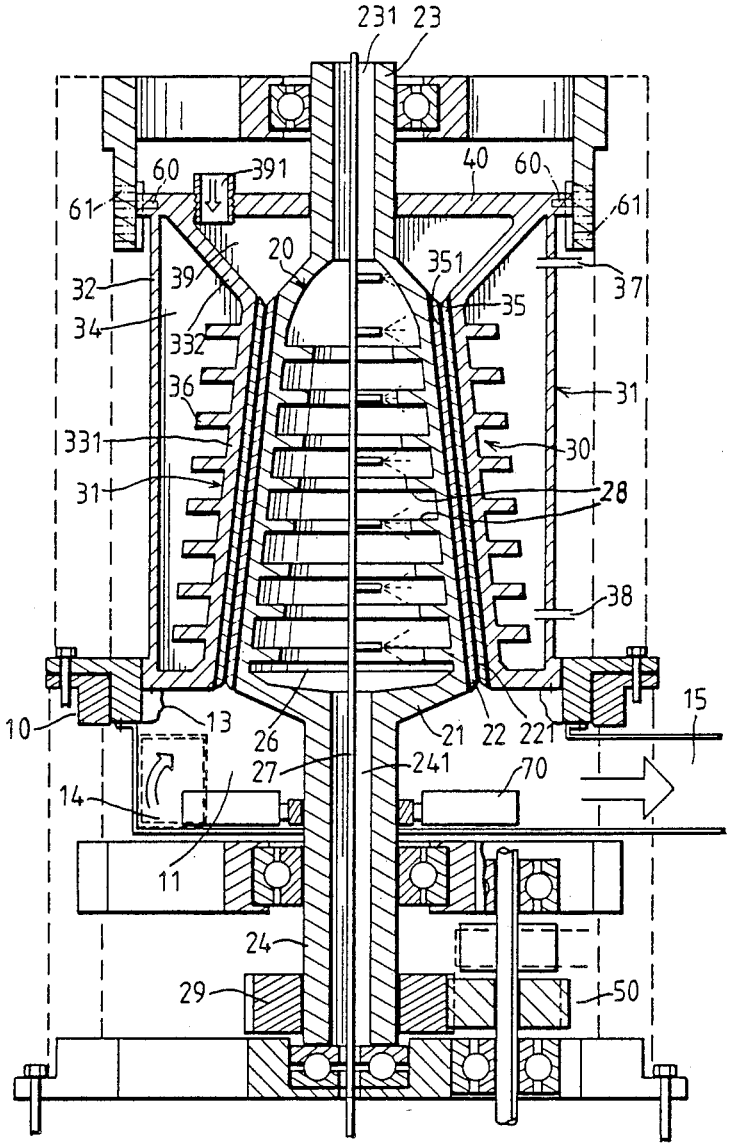
FIG. 3 is a schematic sectional view of a second preferred embodiment of a grinding apparatus of this invention.

Variably, as illustrated in FIG. 3, the lugs 311 of the drum member 31 and the axial grooves 12 on the frame 10 of the abovementioned embodiment are respectively provided with a pair of opposed radial pins 60 which protrudes from the drum member 31 and two opposed rows of adjust holes 61 formed in the frame 10 which are arranged in different altitudes. The pins 60 are inserted selectively into the adjust holes 61 so as to create clearances of different width between the external and internal frusto-conical grinding surfaces 221, 351. Therefore, when the first and second grinding members 22, 35 start to wear after operating for a period of time, the clearance between the first and second grinding members 22, 35 of the first and second grinding assemblies 20, 30 can still be adjusted to maintain a generally constant width.

With this invention thus explained, it is apparent that numerous modifications and variations can be made without departing from the scope and spirit of this invention. It is therefore intended that this invention be limited only as indicated in the appended claims.

I claim:

1. A grinding apparatus comprising:

a frame;

a first grinding assembly mounted on said frame for rotating about a vertical axis, said first grinding assembly having a substantially truncated cone-shaped member with an external frusto-conical grinding surface, said truncated cone-shaped member being hollow and tapered upward and having a hollow interior opening outwardly at one end thereof, said opening being positioned so as to overlie the axis of rotation of said first grinding assembly, said first grinding assembly further including an upper hollow shaft and a lower hollow shaft axially connected with said truncated cone-shaped member, said hollow interior being defined by a substantially truncated cone-shaped chamber formed in said truncated cone-shaped member, upper and lower channels formed in said hollow shafts which respectively communicate with said truncated cone-shaped chamber one of said channels defining said opening;

a first grinding member borne by said truncated cone-shaped member and provided with said external frusto-conical grinding surface of said first grinding assembly;

a second grinding assembly vertically movably supported on said frame and sleeved around said first grinding assembly, said second grinding assembly having an internal frusto-conical grinding surface for cooperating with said external frusto-conical grinding surface of said truncated cone-shaped member for grinding, said second grinding assembly including a drum member having a cylindrical outer wall and an inner wall which defines an annular chamber with said outer wall, said inner wall surrounding said first grinding member of said first grinding assembly and having an upwardly tapered frusto-conical inner wall portion bearing a second grinding member on which said internal frusto-conical grinding surface is provided, said drum member also including a pair of diametrically opposed lugs protruding therefrom and said frame has two opposed axial grooves formed thereon, said lugs being axially and slidably received in said axial grooves so that said second grinding assembly can move upward and downward in said frame and being prevented from rotation relative to said frame;

a cooling tube for cooling said first grinding assembly extending through said hollow interior and said opening and being positioned in spaced relationship to said first grinding assembly, said cooling tube extending through said channels and said chamber; and means for rotating said first grinding assembly about said vertical axis.

2. A grinding apparatus as claimed in claim 1, wherein each of said lugs of said drum member has a radial pin protruding therefrom and said frame has two opposed rows of adjust holes correspondingly arranged in different altitudes, said pins being inserted selectively into said adjust holes so as to create clearances of different width between said external and internal frusto-conical grinding surfaces.

3. A grinding apparatus as claimed in claim 1, wherein said truncated cone-shaped member of said first grinding assembly has an inner face at the opposite of said external frusto-conical grinding surface and a plurality of ribs projecting radially and inwardly from said inner face; and said inner wall of said second grinding assembly has an inner face at the opposite side of said internal frusto-conical grinding surface and a plurality of annular protrusions formed on said inner face of said second grinding assembly.

4. A grinding apparatus as claimed in claim 1, wherein said frame has a powder-receiving chamber provided under said first and second grinding assemblies, said powder-receiving chamber having an air-blowing port, a powder-outlet and a fan connected to said hollow shaft of said first grinding assembly so as to rotate with the same.

5. A grinding apparatus as claimed in claim 1, wherein said inner wall of said drum member further includes an upwardly diverging frusto-conical inner wall portion extending from said upwardly tapered frusto-conical inner wall portion to said outer wall, and a cover formed above said upwardly diverging frusto-conical inner wall portion defining a feeding chamber with an upper end of said truncated cone-shaped member of said first grinding assembly, said cover being passed through by said upper hollow shaft of said first grinding assembly and having a feeding opening formed thereof.

6. A grinding apparatus as claimed in claim 1, wherein said external grinding surface and said internal grinding surface are substantially smooth so as to matingly contact each other when said grinding apparatus is not in use.

* * * * *